United States Patent [19]

Kuch et al.

[11] Patent Number: 4,737,894

[45] Date of Patent: Apr. 12, 1988

[54] INTEGRAL BALL POINT PEN AND LIGHT

[76] Inventors: Yilmaz Kuch, 310 Sixth Ave. #12, San Francisco, Calif. 94118; Nilufer Richardson, 993 South Van Ness Ave., Apt. 3, San Francisco, Calif. 94110; Muge Arikan, 310 Sixth Ave. #12, San Francisco, Calif. 94118

[21] Appl. No.: 37,587

[22] Filed: Apr. 10, 1987

[51] Int. Cl.[4] ..... B43K 29/10

[52] U.S. Cl. ..... 362/118

[58] Field of Search ..... 362/118, 32

[56] References Cited

U.S. PATENT DOCUMENTS

| | | | |
|---|---|---|---|
| 1,345,962 | 7/1920 | Sanders | 362/118 |
| 1,498,643 | 6/1924 | Cawley | 362/118 |
| 1,588,891 | 6/1926 | Hug | 362/118 |
| 3,004,140 | 10/1961 | Gomes | 362/118 |
| 3,045,111 | 7/1962 | Hoenig | 362/118 |
| 3,122,328 | 2/1964 | Weber | 362/118 |
| 3,303,337 | 2/1967 | Cheung Lo | 362/118 |
| 3,333,095 | 7/1967 | Moess | 362/118 |
| 3,384,742 | 5/1968 | Delligatti | 362/118 |
| 3,502,859 | 3/1970 | Kochan | 362/32 |
| 4,016,414 | 4/1977 | Browning et al. | 362/118 |
| 4,047,017 | 9/1977 | Herring | 362/118 |
| 4,168,521 | 9/1979 | Bajusz | 362/118 |

*Primary Examiner*—Charles J. Myhre
*Assistant Examiner*—David A. Okonsky
*Attorney, Agent, or Firm*—Alfons Puishes

[57] ABSTRACT

A ball point pen operating in a conventional manner is modified to incorporate within itself a battery which is wired to electric light bulbs situated near the point of the pen and focusing on the point to aid in writing in the dark or dimly lighted areas. Novel construction of a mechanism associated with the ball point makes possible operation of the ball point mechanism simultaneous with the functioning of the battery and lights.

3 Claims, 1 Drawing Sheet

INTEGRAL BALL POINT PEN AND LIGHT

FIELD OF THE INVENTION

This invention lies in the field of writing instruments in general and ball point pens in particular in combination with illuminating devices to facilitate writing in the dark.

BACKGROUND OF THE INVENTION AND PRIOR ART

The problem of writing in the dark or writing in poorly illuminated areas has occupied the attention of inventors for same time. Patents known by applicants to have issued are set forth below.

U.S. Pat. No. 1,345,962 to Sanders. This teaches the construction of a small flashlight simply clamped to the body of a writing instrument and focusing on the writing point.

U.S. Pat. No. 1,498,643 to Cawley. This patent discloses a light attached to the writing end of an instrument and includes a switch which turns the light on when the writing instrument makes contact with the paper.

U.S. Pat. No. 1,588,891 to Hug. This patent discloses a light detachably mounted on a pen and wired to a battery which is constructed to strap on to the wrist of the writer.

U.S. Pat. No. 4,047,017 to Herring. In this patent a flashlight is mounted to a writing instrument by means of an adjustable bracket and lever arrangement. This makes it possible to vary the field of illumination while writing and to fold up against the writing instrument when not in use.

In all of the prior art the source of illumination is external to the writing instrument and focuses thereon. The applicants are aware of no prior art in which the light forms an integral part of the writing instrument itself and none that would be particularly applicable to a ball point pen in which the light is integral or internal to the pen itself.

The growth and popularity of ball point pens has focused the attention on providing an illuminated pen of this type, while being compatible with the operating mechanism of such a pen.

SUMMARY OF THE INVENTION

We have solved the problem by providing a novel construction and a unique mechanism for operation. We do this as follows.

We start with the basic ball pen concept and first provide an enlarged compartment at the upper or operating button end of the pen in which we locate a small battery. At the opposite or writing end of the pen we provide a second enlarged compartment in which we locate a series of small light bulbs. The body of the pen is made of electrical conducting material which makes contact with one terminal of our battery. From the other terminal of the battery we run a wire to one terminal of the illuminating lights, the other terminal also making contact with the body of the pen to complete this circuit. We provide a switch which may turn the light off when not in use and provide for light when the pen is not in use if desired preparatory to the starting of the writing operation.

By use of a special construction inside the battery compartment we make it possible to operate the ball point in and out by means of a conventional starting button without disturbing the position or function of the battery or operation of the lights.

DESCRIPTION OF A PREFERRED EMBODIMENT

Figure 1:
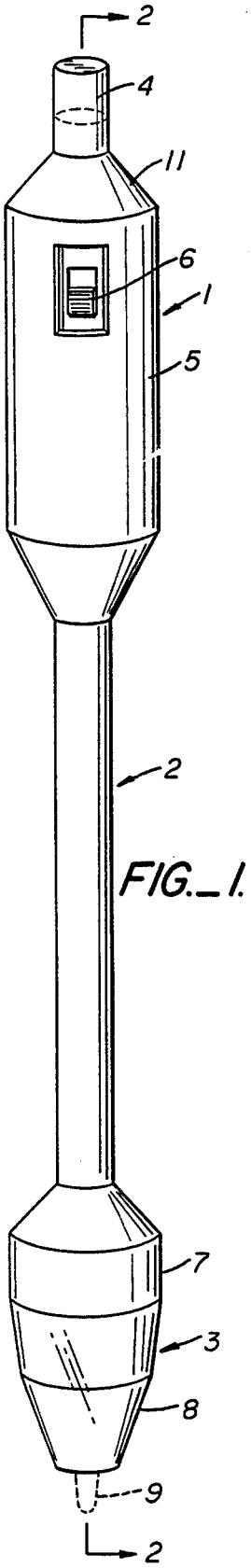
FIG. 1 is a side elevation of the device of our invention.

Referring now first to FIG. 1 there is shown the upper section or battery compartment at 1, the central section or handle of the pen 2 and the lower section or light compartment 3. The former two sections are made from electrically conductive material while the latter comprises a translucent material as described more fully below. A conventional operating button is shown at 4. The housing which is the principal part of upper section 1 is shown at 5 and the light switch at 6. At the lower end of the pen and forming a part of lower section 3 are seen the light housing 7 which is also made of electrically conductive material and the lower or translucent portion of this section is seen at 8. The ball point shown in its protruded position is seen at 9.

Figure 2:
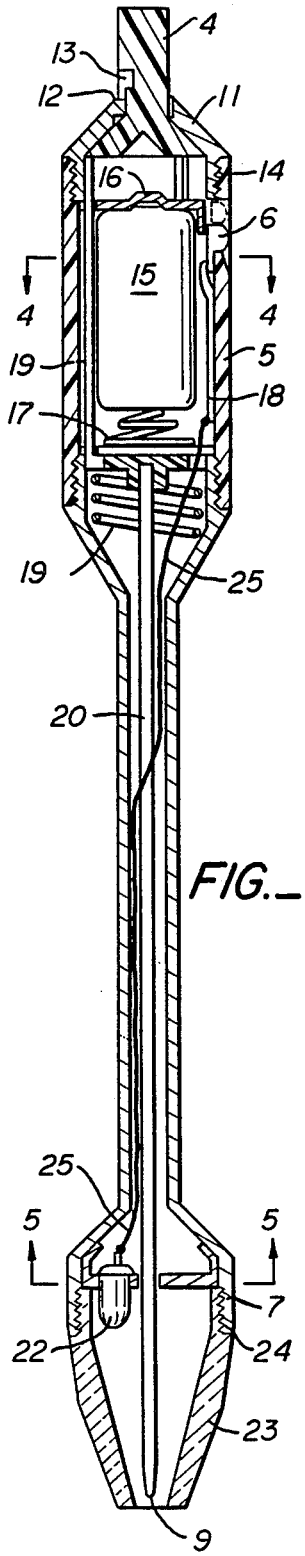
FIG. 2 is a longitudinal section along the lines 2—2.
Figure 3:
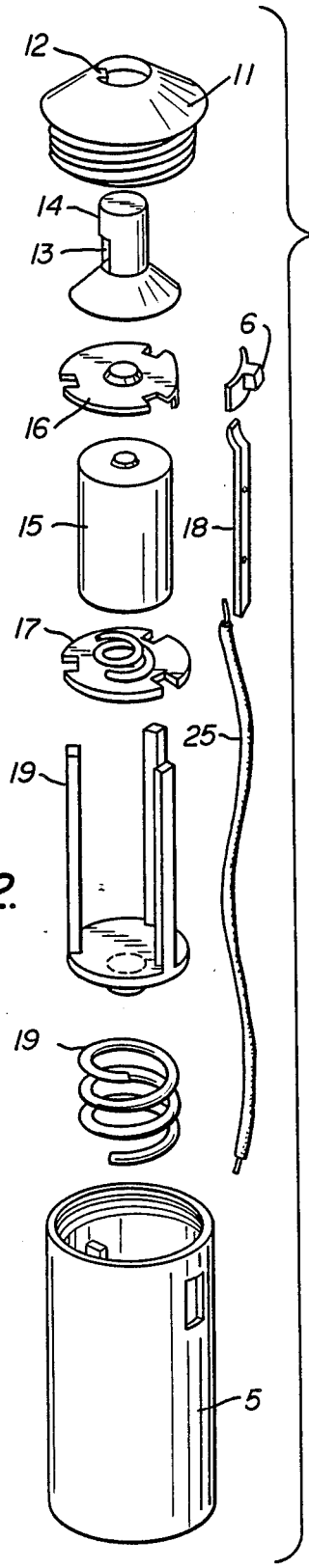
FIG. 3 is an exploded view showing the component parts.
Figure 4:
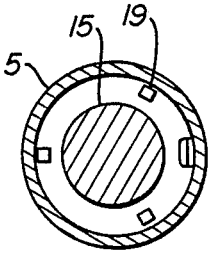
FIG. 4 is section 4—4 through the battery compartment of FIG. 2.
Figure 5:
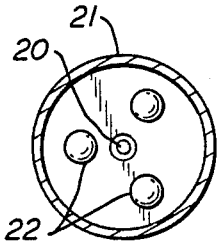
FIG. 5 is section 5—5 through the lighting compartment of FIG. 2.
Figure 6:
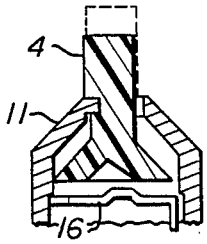
FIG. 6 shows the upper portion of the battery compartment and operating button.

Referring now more particularly to FIG. 2 and also to FIG. 3, there is seen top cap 11 having engaging lip 12 and notch 13 in cap 4 which are the equivalent of conventional ball point operating mechanisms. A threaded section 14 engages top cap 11 with housing 5. The battery which may be of the small cylindrical type now in popular use is shown at 15 and is clamped in position to clamp 16 through an insulating washer not shown. Spring washer 17 helps hold battery 15 in position. Switch connector 18 is positioned in housing 5 but insulated therefrom by means of an insulating strip not shown.

Pen point depresser element 19 has the unusual construction shown which enables the operating button 4 to depress the pen point stem 20 against the action of spring **19*a* without interfering with battery 15**.

At the bottom of the pen is seen light socket holder 21 positioned inside light housing 7 and making electrical contact therewith. The light bulbs, which may be three in number, are of the small instrument variety and are shown at 22 and project their light through translucent cover 23 of lower section 3. A connecting wire 25 connects the inside terminal of light bulbs 22 to switch connector 18 and thence to switch 6 and central terminal of battery 15.

It is seen from the foregoing that we are able to maintain operation of our ball point pen while at the same time effecting illumination of the writing area.

We claim:

1. In a ball point pen having an operating button at a first end and a writing ball at a second end and a stem means connecting said button with said ball the improvement comprising:

a first enlarged hollow portion comprising a first compartment positioned at said first end;

a second enlarged hollow portion comprising a second compartment positioned at said second end;

a battery positioned in said first compartment;

electric light bulbs positioned in said second compartment;

said second compartment being characterized by translucent external walls;

electrical connecting means between said battery and said bulbs;

a switch inserted in said electrical connecting means;

said stem means being positioned in part within said first compartment for operatively connecting said button with said ball;

said stem means being further so positioned as to avoid contact with said battery and said connecting means.

2. The pen of claim 1 in which said battery is positioned between said button and said stem means and said connecting means is positioned between said button and said stem means, said stem means comprising:

a depresser unit;

said depresser unit comprising a plurality of vertical prongs;

said prongs being disposed to straddle said battery;

said prongs being further disposed to transmit the vertical motion of said button to said ball.

3. A ball point pen with integral light comprising;

an elongated hollow central section;

a first enlarged hollow section comprising a compartment positioned on a first end of said central section;

a second enlarged hollow section comprising a compartment positioned on a second end of said central section;

said central section and said first section being composed of an electrically conductive material;

said second section being composed of translucent material;

a battery fixedly positioned in said first section and having a first terminal in electrical contact with said compartment;

an elongated ball point pen member slidably positioned within said central section;

said pen member having a ball point initially positioned within said section section;

means positioned in said first section in operative relation with said pen member to cause said ball point to alternately protrude from and withdraw into said second section;

electrical illuminating means having two terminals fixedly positioned within said second section;

a first of said terminals being disposed to make electrical contact with said central section and said compartment of said first section;

electrical means connecting a second of said terminals of said illuminating means to a second terminal of said battery;

a switch interposed in said electrical connecting means.

* * * * *